US008695411B2

(12) United States Patent
Okazawa et al.

(10) Patent No.: US 8,695,411 B2
(45) Date of Patent: Apr. 15, 2014

(54) OIL-PRESSURE DETERMINATION APPARATUS OF ENGINE

(75) Inventors: Hisashi Okazawa, Hiroshima (JP); Masaaki Sato, Hiroshima (JP); Hirofumi Ohmori, Hiroshima (JP); Nobuhiro Fujii, Hiroshima (JP); Yuji Wakida, Hiroshima (JP); Tomokuni Kusunoki, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 26 days.

(21) Appl. No.: 13/475,731

(22) Filed: May 18, 2012

(65) Prior Publication Data

US 2012/0291536 A1 Nov. 22, 2012

(30) Foreign Application Priority Data

May 19, 2011 (JP) ..... 2011-112223

(51) Int. Cl.
*G01M 15/09* (2006.01)

(52) U.S. Cl.
USPC ..... 73/114.57

(58) Field of Classification Search
USPC ..... 73/114.57
See application file for complete search history.

(56) References Cited

U.S. PATENT DOCUMENTS

| | | | | | |
|---|---|---|---|---|---|
| 3,723,964 | A * | 3/1973 | Lace | 340/459 |
| 4,021,794 | A * | 5/1977 | Carlson | 340/522 |
| 4,054,117 | A * | 10/1977 | Palmer et al. | 123/198 D |
| 4,059,087 | A * | 11/1977 | Tanigami et al. | 123/196 S |
| 4,328,480 | A * | 5/1982 | Keitel et al. | 340/451 |
| 4,489,311 | A * | 12/1984 | Lang et al. | 340/501 |
| 4,504,819 | A * | 3/1985 | Hosoya | 340/450.3 |
| 4,984,543 | A * | 1/1991 | Tharman | 123/179.1 |
| 5,107,248 | A * | 4/1992 | Koiwa et al. | 340/451 |
| 5,229,745 | A * | 7/1993 | Koide et al. | 340/451 |
| 6,571,157 | B1 * | 5/2003 | Dahlin et al. | 701/22 |
| 6,614,345 | B2 * | 9/2003 | Kimata et al. | 340/450.3 |
| 6,732,576 | B2 * | 5/2004 | Hoshiba et al. | 73/114.57 |
| 8,417,440 | B2 * | 4/2013 | Takahashi | 701/114 |
| 2002/0011098 | A1 * | 1/2002 | Hoshiba et al. | 73/117.3 |
| 2002/0067251 | A1 * | 6/2002 | Kimata et al. | 340/450.3 |
| 2011/0041798 | A1 * | 2/2011 | Takahashi | 123/196 S |

* cited by examiner

*Primary Examiner* — Freddie Kirkland, III
(74) *Attorney, Agent, or Firm* — Studebaker & Brackett PC

(57) ABSTRACT

A state of an oil pressure is determined based on combination of activation of an oil pressure switch and information of the temperature detected by a temperature sensor and an engine speed detected by an engine speed sensor such that determination of the oil-pressure state is conducted from a lower engine-speed range in a case in which the temperature detected by the temperature sensor is relatively low, compared with a case in which the temperature detected by the temperature sensor is relatively high. Accordingly, the oil-pressure state can be properly determined not only in a high engine-speed range but in a low engine-speed range, by utilizing the simple oil pressure switch activated to the conductive state in response to the oil pressure.

10 Claims, 3 Drawing Sheets

OIL-PRESSURE DETERMINATION APPARATUS OF ENGINE

BACKGROUND OF THE INVENTION

The present invention relates to an oil-pressure determination apparatus of an engine.

An oil pump to supply oil for lubricating or cooling to engine components is driven by an engine. Herein, if the pressure of the oil decreases to an improperly-low oil pressure, there is a concern that an engine seizure may occur. Accordingly, in general, an oil pressure switch is provided in an oil passage downstream of the engine pump to warn such a situation of the oil pressure's decreasing improperly. The oil pressure switch is activated to a conductive state in response to a specified setting oil-pressure (threshold). Herein, this specified setting oil-pressure (threshold) is generally set at a low pressure so that the above-described decrease of the oil pressure can be properly detected even in an idling operation of the engine.

However, this setting of the specified setting oil-pressure at the low pressure causes a problem in that an operation of the oil pressure switch may be easily influenced by fluctuation in oil pressure in response to changes of the engine operating state or the vehicle traveling state. That is, there is a possibility that the state of the oil pressure switch may change between the conductive state and the non-conductive state thereof repeatedly even though the oil pressure has no abnormality, thereby making a warning lump flash improperly. Accordingly, a vehicle driver may feel uneasy. In this regard, U.S. Pat. No. 5,229,745 discloses a technology in which even though the state of the oil pressure switch changes to the conductive state (i.e., shortage of the oil pressure), any warning is not given until a specified time has passed from the timing the engine starts. On the other hand, after the specified time has passed, once the state of the oil pressure switch changes to the conductive state, the warning is maintained despite the state of the oil pressure switch changing to the non-conductive state.

In order to solve the above-described problem of the inappropriate influence of the oil pressure fluctuation on the oil pressure switch, it may be considered that the above-described setting oil-pressure of the oil pressure switch is set at a high pressure instead of relying on the technology of the above-described patent document. However, the oil pressure is generally influenced by the viscosity of the oil, i.e., the temperature of the oil, so that in a case in which the temperature is relatively high, the oil pressure may not increase up to the setting oil-pressure of the oil pressure switch unless the engine speed increases to some extent, compared with a case in which the temperature is relatively low. Therefore, in order to properly determine a state of the oil pressure regardless of the level of the temperature, it may be necessary to detect an operation state of the oil pressure switch at the timing the engine speed increases above a specified speed (2500 rpm, for example). This means that the oil-pressure state cannot be properly determined in a whole engine operation range covering the practical speeds of the engine, including the idling speed of the engine, that is, that the determination in the engine operation rage of the low speed needs to be excluded. However, even when the engine speed is low, any malfunction of a circulation system may cause the engine seizure. Meanwhile, it may be considered that an oil-pressure sensor which can detect the oil pressure linearly is used, but the cost of this sensor may be generally high.

SUMMARY OF THE INVENTION

An object of the present invention is to provide an oil-pressure determination apparatus of an engine which can determine the oil-pressure state properly not only in a high engine-speed range but in a low engine-speed range, by utilizing a simple oil pressure switch activated to the conductive state in response to the oil pressure.

According to the present invention, there is provided an oil-pressure determination apparatus of an engine, comprising an oil pump driven by the engine, an oil supply passage supplying oil from the oil pump to engine components therethrough, a relief mechanism provided in the oil supply passage to relieve the oil so as to restrain an increase of an oil pressure of the oil, an oil pressure switch activated to a conductive state in response to a specified setting oil-pressure (threshold) of the oil supplied to the engine components, a temperature sensor detecting temperature of engine cooling water or the oil, an engine speed sensor detecting an engine speed, and a determination device determining a state of the oil pressure based on combination of activation of the oil pressure switch and information of the temperature detected by the temperature sensor and the engine speed detected by the engine speed sensor such that determination of the oil-pressure state is conducted from a lower engine-speed range when the temperature detected by the temperature sensor is relatively low, compared with a situation when the temperature detected by the temperature sensor is relatively high.

According to the above-described oil-pressure determination apparatus, when the temperature is low, the determination of the oil-pressure state based on the activation of the oil pressure switch is conducted from the lower engine-speed range. That is, a chance to determine the oil-pressure state can be got from an early stage after the engine starting (i.e., even in a low engine-speed range where the engine peed is low). Thus, according to the present invention, the determination of the oil-pressure state is conducted based on the combination of the activation of the oil pressure switch and information of the temperature and the engine speed, so that the oil-pressure state can be properly determined not only in the high engine-speed range but in the low engine-speed range, by utilizing the simple oil pressure switch activated to the conductive state in response to the oil pressure.

According to an embodiment of the present invention, the specified setting oil-pressure (threshold) for switching the state of the oil pressure switch between conductive and non-conductive states thereof is set to be higher than a half value of the oil pressure at which the relief mechanism relieves the oil. Thereby, it can be restrained that the operation of the oil pressure switch is influenced by the fluctuation in oil pressure, so that the determination accuracy of the oil-pressure state can be improved.

According to another embodiment of the present invention, a determination range of the oil-pressure state determined by the determination device is separated into at least three ranges in accordance with the temperature detected by the temperature sensor and the engine speed detected by the engine speed sensor, the three ranges comprising a first determination range where the determination by the determination device is conducted when the temperature is relatively low and the engine speed is a specified first setting speed or higher, a second determination range where the determination by the determination device is conducted when the temperature is middle and the engine speed is a specified second setting speed or higher, and a third determination range where the determination by the determination device is conducted when the temperature is relatively high and the engine speed is a specified third setting speed or higher, the specified first setting speed being lower than the specified second setting speed or the specified third setting speed, and the specified second setting speed being lower than the specified third setting speed. That is, in a case in which the oil pump is driven by the engine, an increase state of the oil pressure, i.e., when (at what engine speed) the oil pressure goes up to the specified setting oil-pressure (threshold) of the oil pressure switch depends on the temperature. Therefore, according to this embodiment, the determination range of the oil-pressure state is separated into at least three ranges in accordance with the temperature of the engine cooling water or oil and the engine speed, where the determination by the determination device is conducted as described above. Thereby, the oil-pressure state can be determined timely and accurately in each of the determination ranges.

According to another embodiment of the present invention, the relief mechanism relieves the oil such that the oil pressure for relieving the oil is controlled at two stages of a low relief oil-pressure and a high relief oil-pressure in accordance with the engine speed or an engine load, and the specified setting oil-pressure for switching the state of the oil pressure switch between conductive and non-conductive states thereof is set to be lower than the low relief oil-pressure. Thereby, the abnormality of the oil pressure (the shortage of oil pressure) can be determined surely even when the oil pressure is controlled to a lower side by the relief mechanism so that a resistance of the oil pump can lower. Accordingly, any engine damage can be prevented properly.

Other features, aspects, and advantages of the present invention will become apparent from the following description which refers to the accompanying drawings.

DETAILED DESCRIPTION OF THE INVENTION

Hereinafter, a preferable embodiment of the present invention will be described referring to the accompanying drawings. Herein, the preferable embodiment described here is merely one example of the present invention, therefore the present invention and its applications or uses should not be limited by this embodiment.

Figure 1:
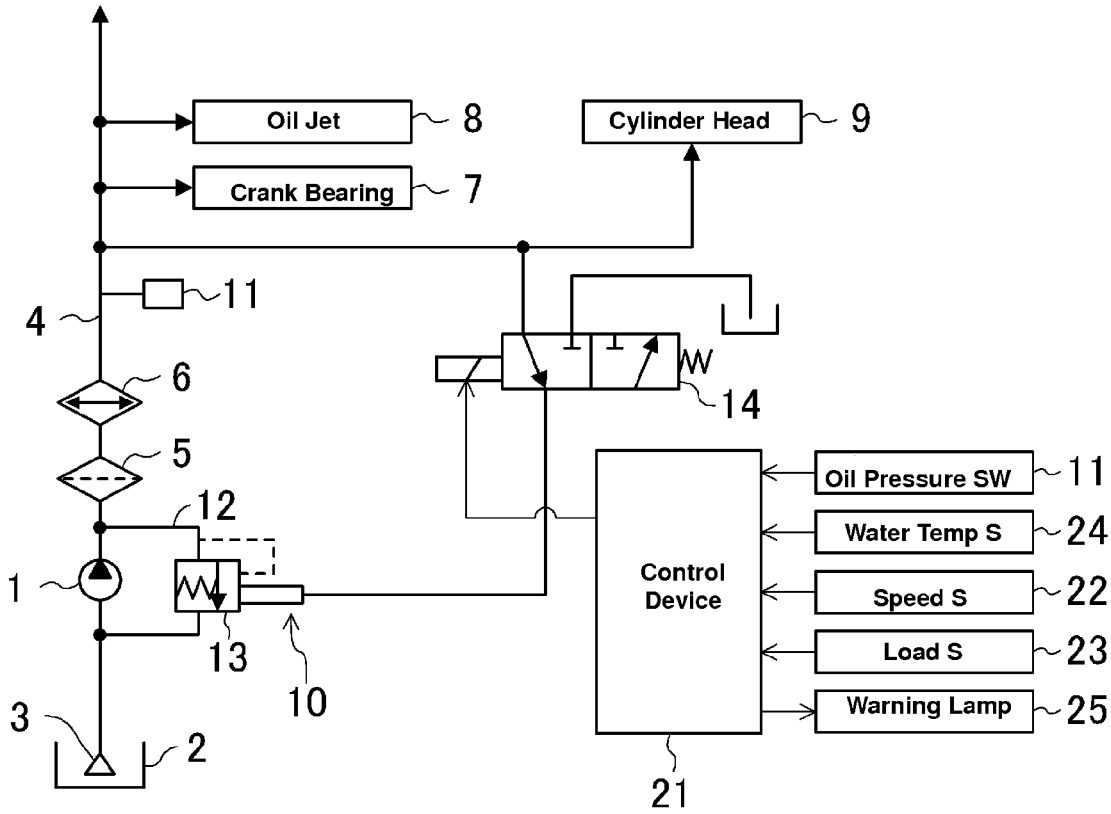
FIG. 1 is a diagram showing an oil supply system of an engine.

In an oil supply system of the engine shown in FIG. 1, reference numeral 1 denotes an oil pump driven by the engine of a vehicle and reference numeral 2 denotes an oil pan. The oil in the oil pan 2 is sucked up by the oil pump 1 via an oil strainer 3. The oil sucked up is supplied to various engine components, such as a journal 7 of a crankshaft, an oil jet for cooling piston 8, and a cylinder head 9, through an oil supply passage 4 via an oil filter 5 and an oil cooler 6. In the oil supply passage 4 are provided a relief mechanism 10 to relieve the oil from the oil pump 1 so as to restrain (control) the oil pressure to a specified pressure and an oil pressure switch 11 to determine a state of the oil pressure supplied to the engine components via the relief mechanism 10.

The relief mechanism 10 comprises a relief passage 12 which returns the oil from the oil pump 1 toward a suction side of the oil pump 1, a relief valve 13 which is provided in the relief passage 12, and a switching valve 14 which switches a relief pressure of the relief valve 13. This switching valve 14 is an electromagnetic valve taking two positions, a low-pressure position to make the relief pressure low and a high-pressure position to make the relief pressure high. When the switching valve 14 takes the low-pressure position, the oil pressure downstream of the oil pump 1 in the oil supply passage 4 is applied to a back-pressure chamber of a valve body of the relief valve 13 in a valve-open direction, so that the relief pressure is controlled at a low-pressure setting value. Meanwhile, when the switching valve 14 takes the high-pressure position, the back-pressure chamber of the relief valve 13 is open toward a side of the oil pan 2, so that an opening angle of the valve body decreases and thereby the relief pressure is controlled at a high-pressure setting value.

The switching valve 14 is switched between the low-pressure position and the high-pressure position in accordance with the engine operating state. For this switching, a control device 21 including an oil-pressure control means is provided. Signals of a speed sensor 22 to detect an engine speed and a load sensor 23 to detect an engine load are inputted to the oil-pressure control means. That, is, the oil-pressure control means in the control device 21 controls such that the switching valve 14 is switched from the low-pressure position to the high-pressure position when the engine speed is a specified speed or greater or the engine load is a specified load or greater.

Figure 2:
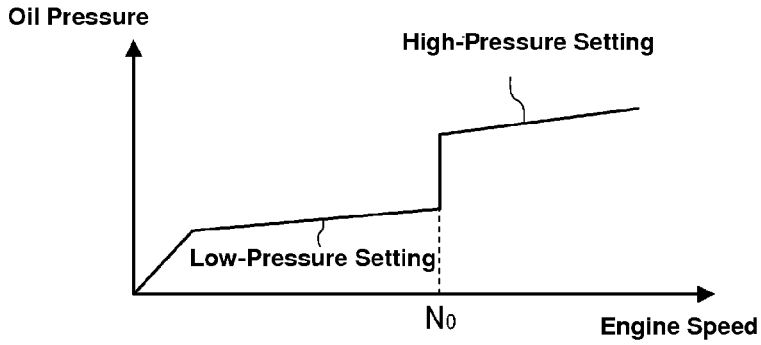
FIG. 2 is a graph showing a two-stage change of an oil pressure controlled by a relief mechanism.

FIG. 2 shows an example in which the relief pressure of the relief valve 13 is switched in accordance with the engine speed. The oil pressure of the oil supplied to the engine components increases as the engine speed increases. When the oil pressure reaches the low-pressure setting value of the relief pressure, further increasing of the oil pressure is restrained by oil relieving of the relief valve 13. When the engine speed increases and then exceeds a specified engine speed $N_0$, the switching valve 14 is switched from the low-pressure position to the high-pressure position. Accordingly, the relief pressure of the relief valve 13 becomes the high-pressure setting value. Thereby, the oil pressure increases once, and further increasing of the oil pressure is restrained by oil relieving of the relief valve 13 with the high-pressure setting value.

The oil pressure switch 11, which is activated to the conductive state in response to a specified setting oil-pressure (threshold) of the oil supplied to the engine components, is a normal-close type of switch in which the switch 11 outputs an OFF signal (a signal of the non-conductive state) signal when the oil pressure exceeds the specified setting oil-pressure value and provided downstream of the relief valve 13 in the oil supply passage 4. The specified setting oil-pressure (threshold) for switching the state of the oil pressure switch 11 between its conductive and non-conductive states is set to be higher than a half value of the above-described low-pressure setting value of the relief pressure and lower than the low-pressure setting value of the relief pressure.

The above-described control device 21 further includes a determination means (i.e., a determination device) which determines a state of the oil pressure of the oil supplied to the engine components based on activation of the oil pressure switch 11. A signal from a temperature sensor 24 to detect the temperature of the engine cooling water is also, in addition to the oil pressure switch 11 and the speed sensor 22, inputted to the control device 21 for determination of the oil-pressure state. When it is determined that the oil-pressure state has abnormality, a signal of making a warning lump 25 provided at an instrument panel of the vehicle flash is outputted by the determination.

Figure 3:
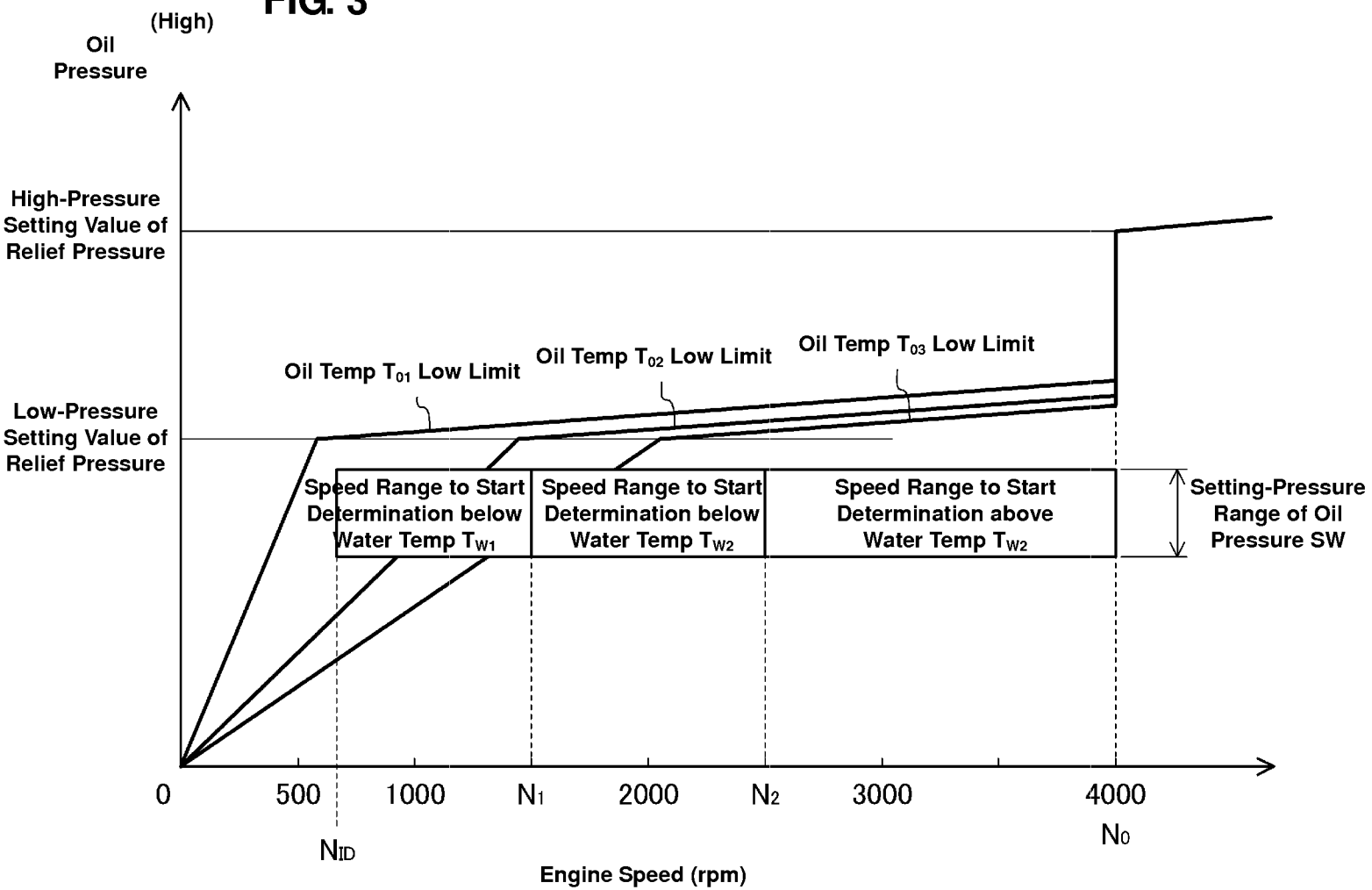
FIG. 3 is a graph showing that an engine speed range for starting determination of a state of the oil pressure depends on a temperature.

Herein, whether the oil pressure has the abnormality or not can be determined by checking the state, the conductive or non-conductive states, of the oil pressure switch 11 when it is expected that the oil pressure increases beyond the specified setting oil-pressure of the oil pressure switch 11 as the engine speeds increases. However, the oil pressure is influenced by the viscosity of the oil, i.e., the temperature of the oil. Accordingly, as shown in FIG. 3, in a case in which the temperature is relatively low, the oil pressure increases quickly as the engine speeds increases, however, this increasing speed of the oil pressure decreases in a case in which the temperature is relatively high. In FIG. 3, it is set such that $T_{01}<T_{02}<T_{03}$. Thereby, the engine speed when the oil pressure exceeds the specified setting oil-pressure of the oil pressure switch 11 depends on the oil temperature such that it is relatively low in the case of the low temperature, while it is relatively high in the case of the high temperature.

Therefore, in determining the oil-pressure state by the determination means in the control device 21, information of the temperature detected by the temperature sensor 24 and the engine speed detected by the speed sensor 22 is combined with the activation of the oil pressure switch 11. In the present embodiment, the temperature of the engine cooling water (hereinafter, referred to as "water temperature") is used for the determination in place of the oil temperature. That is, a temperature range of the engine cooling water which corresponds to a whole engine operation range is separated into three ranges, a low temperature range where the water temperature is $T_{w1}$ or lower, a middle temperature range where the water temperature is higher than (exceeds) $T_{w1}$ and $T_{w2}$ or lower, and a high temperature range where the temperature is higher than (exceeds) $T_{w2}$. Herein, it is set that $T_{w1}<T_{w2}$. Further, engine-speed ranges where the oil pressure exceeds the specified setting oil-pressure (threshold) of the oil pressure switch 11 are set for each of these temperature ranges as shown in FIG. 3.

Specifically, a speed range where the engine speed is an idling seed $N_{ID}$ or higher and lower than a first speed $N_1$ is set for the lower temperature range, a speed range where the engine speed is the first seed $N_1$ or higher and lower than a second speed $N_2$ is set for the middle temperature range, and a speed range where the engine speed is the second speed $N_2$ or higher and a specified speed $N_0$ (an engine speed for switching of the relief pressure from the low-pressure setting value to the high-pressure setting value) or lower is set for the high temperature range. Herein, it is set that $N_{ID}<N_1<N_2<N_0$.

In FIG. 3, an oil-temperature $T_{01}$ low-limit line means that the oil pressure does not lower than this line at the oil temperature $T_{01}$ (30° C.) in a case in which the oil-pressure state is normal. An oil-temperature $T_{02}$ (100° C.) low-limit line and an oil-temperature $T_{03}$ (144° C.) low-limit line mean likewise. Herein, the water temperature $T_{w1}$ corresponds to the oil temperature $T_{01}$, so that when the water temperature is $T_{w1}$ or lower, the oil temperature is necessarily $T_{01}$ or lower. The water temperature $T_{w2}$ corresponds to the oil temperature $T_{02}$, so that when the water temperature is $T_{w2}$ or lower, the oil temperature is necessarily $T_{02}$ or lower.

And, as apparent from the oil-temperature $T_{01}$ low-limit line, it is considered that when the water temperature is $T_{w1}$ or lower, the oil pressure increases beyond a setting-pressure range of the oil pressure switch 11 as long as the oil-pressure state is normal. Herein, this setting-pressure range of the oil pressure switch 11 in FIG. 3 is set considering a performance dispersion of the oil-pressure switch. Accordingly, when the water temperature is $T_{w1}$ or lower, it can be determined whether the oil-pressure state is normal or not by checking the state (i.e., conductive state or non-conductive state) of the oil pressure switch 11 when the engine speed increases over the idling speed $N_{ID}$. Therefore, it is configured such that this determination starts at the timing the engine speed increases up to the idling speed $N_{ID}$ or higher.

Likewise, as apparent from the oil-temperature $T_{02}$ low-limit line, it is considered that when the water temperature is $T_{w2}$ or lower, the oil pressure increases beyond the setting-pressure range of the oil pressure switch 11. Accordingly, when the water temperature is $T_{w2}$ or lower, the determination of the oil-pressure state based on the state (i.e., conductive state or non-conductive state) of the oil pressure switch 11 starts at the timing the engine speed increases up to the first speed $N_1$ or higher.

Further, when the water temperature exceeds $T_{w2}$, the determination of the oil-pressure state based on the state (i.e., the conductive state or the non-conductive state) of the oil pressure switch 11 starts at the timing the engine speed increases up to the second speed $N_2$ or higher. That is, even in a case in which the oil temperature is the abnormally-high temperature $T_{03}$ (144° C.), when the engine speed is the second speed $N_2$ or higher, the oil pressure increases beyond the setting-pressure range of the oil pressure switch 11 in the normal state. Therefore, the state in which the engine speed exceeds the second speed $N_2$ when the water temperature exceeds $T_{w2}$ is set as a condition of the determination starting.

Figure 4:
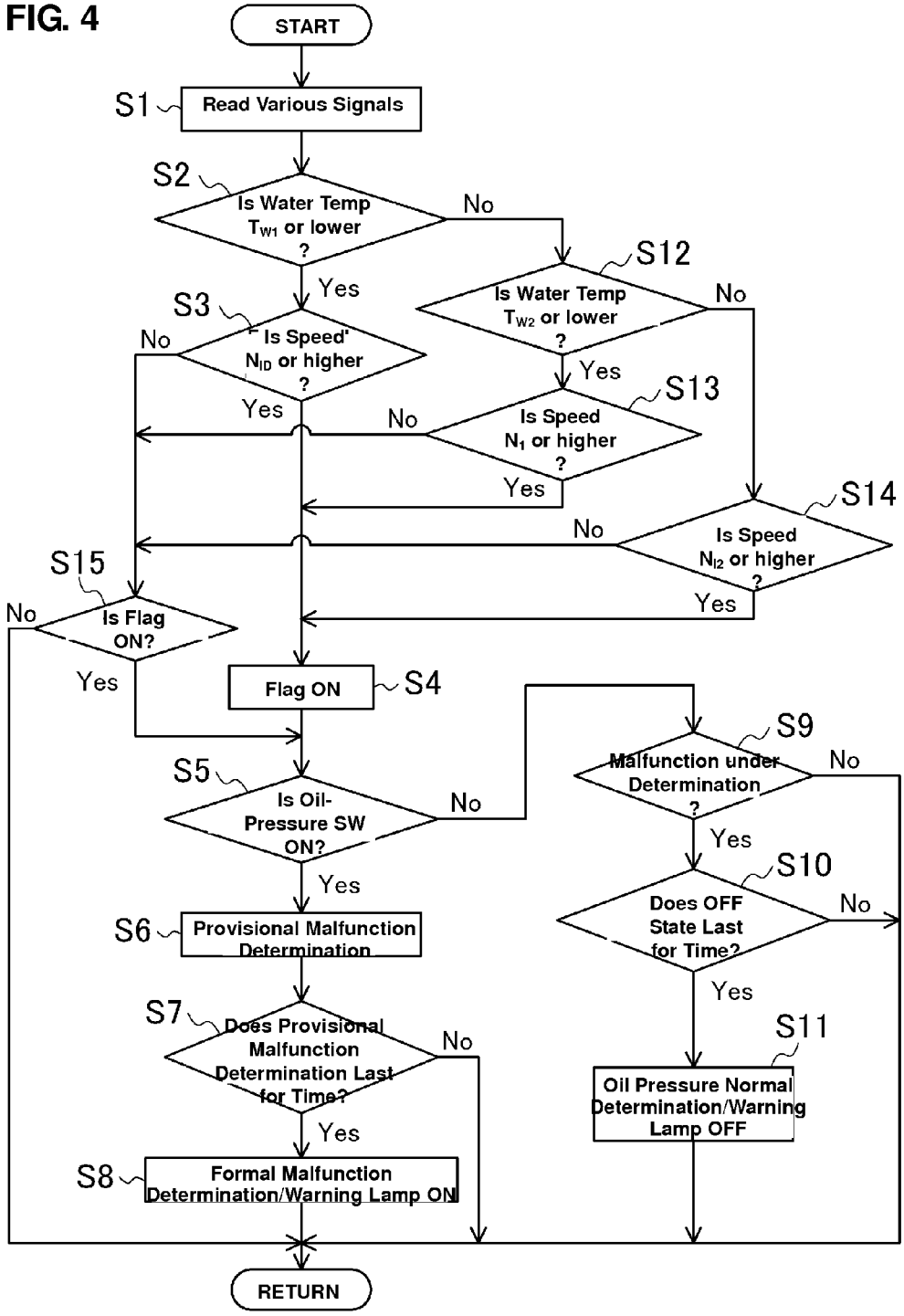
FIG. 4 is a flowchart of the determination of the oil pressure.

FIG. 4 shows a control flow of the determination of the oil-pressure state by the determination means in the control device 21. The ON/OFF signals (signals of the conductive state/non-conductive state) of the oil pressure switch 11 and the detection signals of the speed sensor 22 and the water temperature sensor 24 are read in step S1. In the next step S2, it is determined whether or not the water temperature is the first water temperature $T_{w1}$ or lower. When the water temperature is the first water temperature $T_{w1}$ or lower, the control sequence proceeds to step S3, where it is determined whether or not the engine speed is the idling speed $N_{ID}$ or higher. When the engine speed is the idling speed $N_{ID}$ or higher, it is considered that the oil pressure exceeds the specified setting oil-pressure (threshold). Accordingly, in the next step S4, a determination-start flag is set at ON, and then the determination of the oil-pressure state based on the state (the conductive state or the non-conductive state) of the oil pressure switch 11 is started.

That is, the control sequence proceeds to step S5, where it is determined whether the state of the oil-pressure switch 11 is the conductive state or the non-conductive state. When the state of the oil-pressure switch 11 is the conductive state (i.e., the oil pressure is the specified setting oil-pressure (threshold) of the oil pressure switch 11 or lower), the control sequence proceeds to step S6, where a provisional malfunction determination is conducted. It is determined in the next step S7 whether or not the provisional malfunction determination lasts for a specified time t1. When it is determined that the provisional malfunction determination lasts for the specified time t1, it is considered that the oil-pressure state has some abnormality. Consequently, the control sequence proceeds to step S8, where the formal (regular) malfunction determination is conducted and the warning lamp 25 is made flash, and then the control sequence returns.

Then, when it is determined in the step S5 that the oil pressure switch 11 is in the non-conductive state (the oil pressure exceeds the specified setting oil-pressure of the oil pressure switch 11), the control sequence proceeds to step S9. Herein, in a case in which the provisional malfunction or the formal (regular) malfunction are under determination, the control sequence proceeds to step S10, where it is determined whether or not the non-conductive state of the oil pressure switch 11 lasts for a specified time t2 (t1>t2). When the non-conductive state lasts for the specified time t2, the control sequence proceeds to step S11, where a normality determination of the oil-pressure state is conducted and the warning lamp 25 is turned off. Accordingly, even when the provisional malfunction or the formal (regular) malfunction are determined, if the non-conductive state of the oil pressure switch 11 lasts for the specified time, the provisional malfunction determination or the formal (regular) malfunction determination are cancelled. Herein, the fact of the conduction of the formal (regular) malfunction determination may be kept as historical data relating to the oil-pressure state for references of engine checking or services.

Meanwhile, when the oil-pressure state is normal and it is determined in the step S5 that the oil pressure switch 11 is in the non-conductive state, the control sequence proceeds to the step S9, where it is determined that the malfunctions are not under determination. Consequently, the control sequence returns.

When it is determined in the step S2 that the water temperature exceeds the first water temperature $T_{w1}$, the control sequence proceeds to step S12, where it is determined whether or not the water temperature is the second water temperature $T_{w2}$ or lower. When the water temperature is the second water temperature $T_{w2}$ or lower, the control sequence proceeds to step S13, where it is determined whether or not the engine speed is the first speed $N_1$ or higher. When the engine speed is the first speed $N_1$ or higher, the control sequence proceeds to step S4, where the determination-start flag is set at ON, and then the determination of the oil-pressure state based on the state (the conductive state or the non-conductive state) of the oil pressure switch 11 is started (the steps S5-S11).

When it is determined in the step S12 that the water temperature exceeds the second water temperature $T_{w2}$, the control sequence proceeds to step S14, where it is determined whether or not the engine speed is the second speed $N_2$ or higher. When the engine speed is the second speed $N_2$ or higher, the control sequence proceeds to the step S4, where the determination-start flag is set at ON, and then the determination of the oil-pressure state based on the state (the conductive state or the non-conductive state) of the oil pressure switch 11 is started (the steps S5-S11).

When the determinations of the engine speed in the steps S3, S13 and S14 is NO, the control sequence proceeds to the step S15, where it is determined whether or not the determination-start flag has been set at ON. When it is determined that this flag has been set at ON, the control sequence proceeds to the steps of the oil-pressure state determination after the step S5. That is, once the determination of the oil-pressure state is started, this oil-pressure state determination is controlled so as to last even if the water temperature and the engine speed become out of the conditions of the determination start of the oil-pressure state (the water temperature is $T_{w1}$ or lower and the engine speed is $N_{ID}$ or higher and lower than $N_1$, or the water temperature is $T_{w2}$ or lower and the engine speed is $N_1$ or higher and lower than $N_2$, or the water temperature exceeds $T_{w2}$ and the engine speed is $N_2$ or higher). This control in which the determination is made last regardless of the states of the temperature and the engine speed once the oil-pressure state determination is made start means that the determination range is enlarged such that determination of the oil-pressure state is conducted from the lower engine-speed range in a case in which the temperature is relatively low, compared with a case in which the temperature is relatively high.

As described above, according to the present invention, the determination of the oil-pressure state is conducted based on the combination of the activation of the oil pressure switch and information of the temperature and the engine speed, so that the oil-pressure state can be properly determined not only in the high engine-speed range but in the low engine-speed range, by utilizing the simple oil pressure switch activated to the conductive state in response to the oil pressure. That is, the determination of the oil-pressure state can be conducted from the properly-early stage after the engine start.

The present invention should not be limited to the above-described embodiment and modification, and any other further modifications or improvements may be applied within the scope of a sprit of the present invention.

For example, while the oil-temperature information is obtained from the temperature of the engine cooling water in the above-described embodiment, there may be provided an oil temperature sensor to obtain such the oil-temperature information.

Further, while the temperature range is separated into the three ranges in the above-described embodiment, the number of this separation may be two or four or more. Or, without separating, the above-described temperature range may be set lineally such that the engine speed for starting the determination of the oil-pressure state is lower when the temperature is lower.

What is claimed is:

1. An oil-pressure determination apparatus of an engine, comprising:

an oil pump driven by the engine;

an oil supply passage supplying oil from the oil pump to engine components therethrough;

a relief mechanism provided in the oil supply passage to relieve the oil so as to restrain an increase of an oil pressure of the oil;

an oil pressure switch operative to switch an output-signal state thereof between a conductive state and a non-conductive state when the oil pressure exceeds a specified setting oil-pressure;

a determination device determining a malfunction state of the oil pressure based on switching of the output-signal state of said oil pressure switch;

a temperature sensor detecting temperature of engine cooling water or the oil; and an engine speed sensor detecting an engine speed, wherein said determination device is configured such that determination of the malfunction state of the oil pressure based on the output-signal state of the oil pressure switch is not executed until the engine speed detected by said engine speed sensor reaches a specified lower-limit engine speed, but starts after the engine speed reaches the specified lower-limit engine speed, and said specified lower-limit engine speed for determination start is set to be variable according to the temperature detected by said temperature sensor.

2. The oil-pressure determination apparatus of an engine of claim 1, wherein said specified setting oil-pressure for switching the output-signal state of the oil pressure switch is set to be higher than a half value of the oil pressure at which said relief mechanism relieves the oil.

3. The oil-pressure determination apparatus of an engine of claim 2, wherein said relief mechanism relieves the oil such that the oil pressure for relieving the oil is controlled at two stages of a low relief oil-pressure and a high relief oil-pressure in accordance with the engine speed or an engine load, and said specified setting oil-pressure for switching the output-signal state of the oil pressure switch is set to be lower than said low relief oil-pressure.

4. The oil-pressure determination apparatus of an engine of claim 1, wherein said relief mechanism relieves the oil such that the oil pressure for relieving the oil is controlled at two stages of a low relief oil-pressure and a high relief oil-pressure in accordance with the engine speed or an engine load, and said specified setting oil-pressure for switching the output-signal state of the oil pressure switch is set to be lower than said low relief oil-pressure.

5. The oil-pressure determination apparatus of an engine of claim 1, wherein said setting of the specified lower-limit engine speed for determination start of the determination device according to the temperature detected by the temperature sensor is configured such that the specified lower-limit engine speed for a case in which the temperature detected by the temperature sensor is relatively low is set to be lower than that for a case in which the temperature detected by the temperature sensor is relatively high.

6. The oil-pressure determination apparatus of an engine of claim 5, wherein said specified setting oil-pressure for switching the output-signal state of the oil pressure switch is set to be higher than a half value of the oil pressure at which said relief mechanism relieves the oil.

7. The oil-pressure determination apparatus of an engine of claim 5, wherein said relief mechanism relieves the oil such that the oil pressure for relieving the oil is controlled at two stages of a low relief oil-pressure and a high relief oil-pressure in accordance with the engine speed or an engine load, and said specified setting oil-pressure for switching the output-signal state of the oil pressure switch is set to be lower than said low relief oil-pressure.

8. The oil-pressure determination apparatus of an engine of claim 5, wherein said specified lower-limit engine speed for determination start of the determination device includes at least three lower-limit engine speeds which are respectively set for a relatively-low temperature range, a relatively-middle temperature range, and a relatively-high temperature range, and the lower-limit engine speed for the relatively-middle temperature range is set to be greater than that for the relatively-low temperature range, and the lower-limit engine speed for the relatively-high temperature range is set to be greater than that for the relatively-middle temperature range.

9. The oil-pressure determination apparatus of an engine of claim 8, wherein said specified setting oil-pressure for switching the output-signal state of the oil pressure switch is set to be higher than a half value of the oil pressure at which said relief mechanism relieves the oil.

10. The oil-pressure determination apparatus of an engine of claim 8, wherein said relief mechanism relieves the oil such that the oil pressure for relieving the oil is controlled at two stages of a low relief oil-pressure and a high relief oil-pressure in accordance with the engine speed or an engine load, and said specified setting oil-pressure for switching the output-signal state of the oil pressure switch is set to be lower than said low relief oil-pressure.

* * * * *